United States Patent [19]

Stuart

[11] 3,951,415

[45] Apr. 20, 1976

[54] GOLF CLUB PUTTER SIGHTING DEVICE

[76] Inventor: William H. Stuart, 16287 Scotch Pine, Fountain Valley, Calif. 92708

[22] Filed: July 1, 1974

[21] Appl. No.: 484,438

[52] U.S. Cl. ..... 273/183 D; 273/163 A

[51] Int. Cl.[2] ..... A63B 69/36

[58] Field of Search ..... 273/162 R, 163 R, 163 A, 273/164, 183 R, 183 D, 193 R, 194 R, 194 A; 33/174 F, 227

[56] References Cited

UNITED STATES PATENTS

| | | | |
|---|---|---|---|
| 2,212,651 | 8/1940 | Sanderson | 273/163 R X |
| 2,771,678 | 11/1956 | Hansen | 273/163 A |
| 3,182,401 | 5/1965 | Stevens | 273/162 B X |
| 3,186,092 | 6/1965 | Bertas | 273/163 A X |
| 3,198,525 | 8/1965 | Smith | 273/163 R |
| 3,262,705 | 7/1966 | Nunziato | 273/183 D |
| 3,410,562 | 11/1968 | Lefleur | 273/162 R |
| 3,486,755 | 12/1969 | Hodge | 273/164 |
| 3,549,300 | 12/1970 | Pelz | 273/164 X |
| 3,876,211 | 4/1975 | Caligiuri | 273/183 D |

*Primary Examiner*—Richard J. Apley

[57] ABSTRACT

A golf putter sighting device that includes a clamp that removably and adjustably engages the shaft of the putter with the clamp supporting a rigid outwardly extending body on which two laterally spaced sights are mounted. The clamp is adjusted on the shaft to a position where an imaginary line extending through the sights is normal to the striking face of the putter, and a substantial portion of the body between the sights is obstructed by the shaft when the user is in a putting position and looking down onto the shaft and head of the putter. When the sights are visible as equally spaced on opposite sides of the shaft, the striking face of the putter head is normally disposed to the direction of the swing of the putter head as the latter is used in putting a golf ball.

3 Claims, 8 Drawing Figures

GOLF CLUB PUTTER SIGHTING DEVICE

BACKGROUND OF THE INVENTION

1. Field of the Invention

Golf putter sighting device.

2. Description of the Prior Art

In golfing, certain fundamentals are well known that must be followed to attain a low score. For instance, in putting it is recognized that the swing of the arcuate path through which the putter head moves prior to contacting a golf ball must be axially aligned with the line along which it is desired to propel the ball. Furthermore, it is recognized that the putter head during such a swing must have the straignt ball-striking surface thereof normally disposed relative to the direction of the path through which the putter head moves for the ball to be propelled along a horizontal path that is an axial continuation of the direction of the arcuate swing. Although these fundamentals are recognized, they are difficult for a golfer to carry out.

The primary purpose in devising the present invention is to supply a sighting device that may be removably secured to a putter intermediate the head and handle of the latter, with the device being of such structure that when it is viewed by the user with the putter head adjacent the ball, the user will be visibly informed as to whether the striking surface of the putter head is normally disposed relative to the direction of swing through which the head will move when the user putts. Such information will increase the accuracy with which the user of a device putts.

A major object of the present invention is to supply a golf putter slighting device that may be removably secured to a shaft of a putter without the use of hand tools, is compact, is of simple mechanical structure, can be fabricated from commercially available materials, is inexpensive, simple and easy to use, and when used, will increase the accuracy with which a golf ball may be putted into a hole.

SUMMARY OF THE INVENTION

A golf putter sighting device that includes a spring-loaded clamp having two spaced arms that frictionally clip to a shaft of a golf putter between the head and handle thereof, with the clamp supporting an elongate body in a position under the shaft when the latter is held by the user. The elongate body supports two spaced insignia thereon. When the sighting device is properly adjusted rotatably about the putter shaft, the insignia are spaced such that they are concurrently and equally visible on either side of the putter shaft only when the straight ball-striking surface is normally disposed relative to the line along which it is desired to propel the ball. The user will assume his stance and rotatably adjust the orientation of the putter shaft such that the insignia are concurrently and equally visible on either side of the putter shaft when the putter head is adjacently disposed to the ball and prior to the user moving the putter head through an arcuate path in the direction of which it is desired to putt the golf ball.

Thus, by use of the device, the user axially aligns the swing of the arcuate path through which the putter head moves in making a putting stroke with the line of putt along which it is desired to propel the golf ball, and further aligns the putter head in a position relative to the putting stroke in which the striking face of the putter is normally disposed relative to the path through which the putter head moves.

Due to this positioning of the putter head relative to the path of travel, the user of the device may attain an increased degree of accuracy in putting a golf ball. When it is desired not to use the device as an assist in putting, the device is easily removed from the shaft of the putter, and due to the light weight and compactness of the device it may be easily carried in the pocket of the user until again required.

DESCRIPTION OF THE PREFERRED EMBODIMENT

Figure 1:
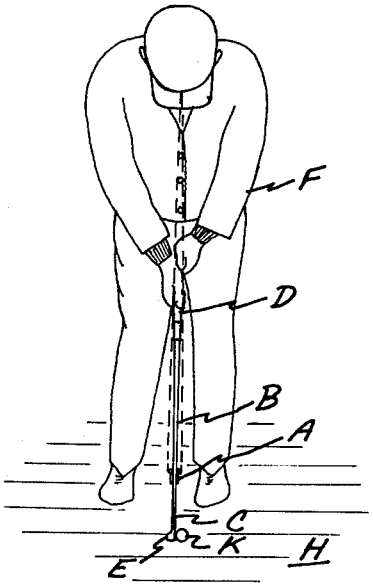
FIG. 1 is a front elevational view of a golfer in a putting position, holding a putter on which the sighting device is removably secured to the shaft of the putter intermediate the head and handle of the latter.
Figure 2:
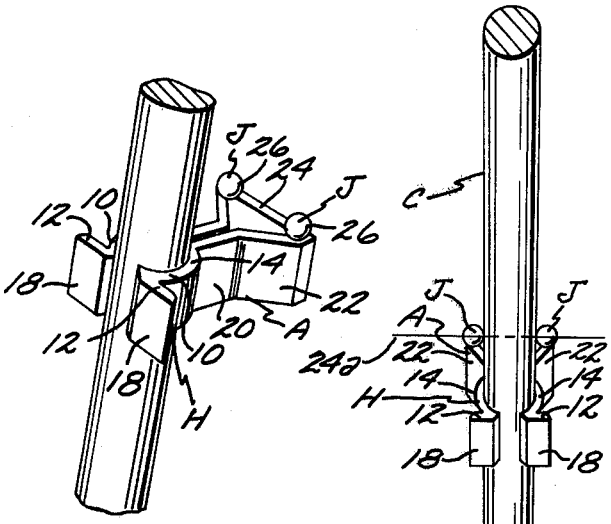
FIG. 2 is a fragmentary perspective view of a first form of the putter sighting device removably mounted on a shaft of a putter.

A first form A of the golf putter sighting device is shown in structural detail in FIGS. 2, 3, 5 and 8, and is illustrated as being removably mounted on a shaft B of a conventional golf putter C having a handle D and a head E. The major portion of the sighting device A as illustrated is molded or formed as an integral unit from a polymerized resin that is rigid but possesses some resiliency. The sighting device A, as best seen in FIG. 2, includes two laterally spaced, arcuate legs 10 that have free first ends 12 and second ends 14 which merge into a transverse web 16. Legs 10 are so spaced as to removably grip a desired portion of shaft B. As may be seen in FIG. 2, legs 10 are of substantial depth.

Short tabs 18 preferable extend outwardly in opposite directions from first legs 10, which tabs serve as guides to direct the legs 10 onto opposite sides of shaft B when a transverse force is exerted on the first form of sighting device A by the user G. The legs 10 and web 14 cooperatively define a clamp that is designated generally by the letter H in the drawing.

The golf putter guide A has two spaced, parallel first ribs 20 the rear ends of these first ribs develop into second outwardly and rearwardly tapered ribs 22. The second ribs 22 are connected to, and support a body 24 that has a length substantially greater than the diameter of that portion of the shaft B adjacent to the first form of the sighting device A.

Figure 3:
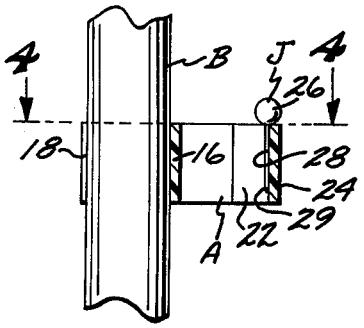
FIG. 3 is a combined side elevational and vertical cross-sectional view of the putter sighting device shown in FIG. 2.
Figure 4:
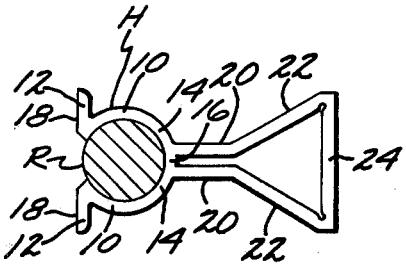
FIG. 4 is a top plan view of the clamp that forms a portion of the sighting device.
Figure 5:
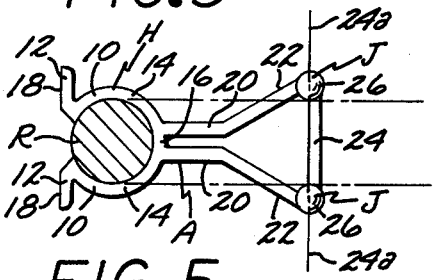
FIG. 5 is a top plan view of the first form of sighting device.
Figure 8:
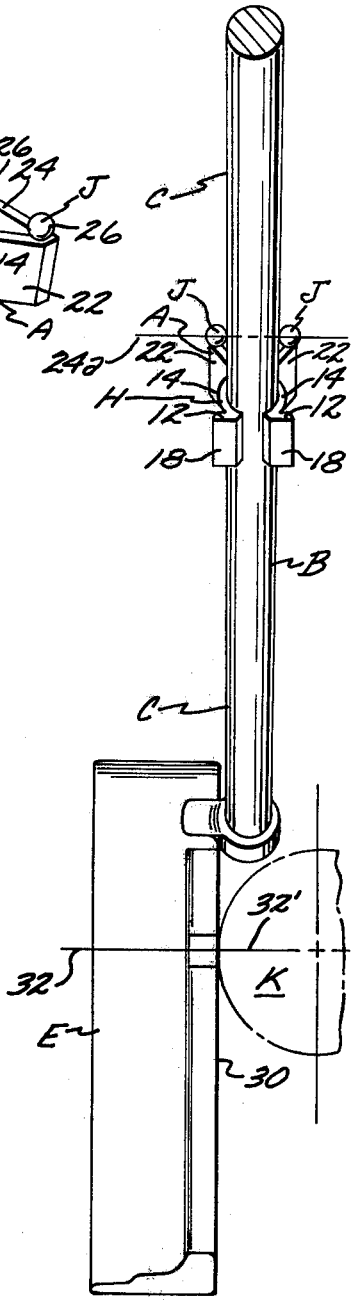
FIG. 8 is a top plan view of a putter which includes the head and a portion of the shaft thereof, and illustrating the manner in which the sighting device is employed to assure the user that the striking surface of the putter head is normally disposed to the path of the arcuate swing when the user is putting.

Two spaced sighting insignia J are supported by body 24, and in axial alignment with a longitudinal axis 24a of the body. In FIG. 3 it will be seen that each insignia J is defined by a pin provided with a colored bead or head 26 from which a shank 28 extends downwardly into a bore 30 formed in body 24. Each shank 28 is of such transverse cross section as to frictionally grip the bore 29 to hold the insignia defining pin J in a fixed position on body 24. After the first form of sighting device A is mounted on shaft B, as shown in FIG. 8, the device is rotatably adjusted on the shaft by the user G after he has taken his normal stance to locate the first and second insignia J where they are concurrently and equally visible on opposite sides of the putter shaft B.

When the sighting device A is so adjusted, the flat striking face 30 of the putter head E is adjacently disposed to a golf ball K, and the face 30 of the putter head disposed normal to the arcuate path 32 through which the head E will move when the user G is putting. In this stance, the arcuate path 32 is coaxially aligned, horizontal with the continuation 32' thereof, which continuation is the path along which it is desired to propel the ball K.

After the sighting device A has been so adjusted, the user G will in the future be assured that when he assumes his normal putting stance and so adjusts the shaft B of putter C, he is able to concurrently see the first and second insignia J, and that the face 30 is normally disposed relative to the arcuate path 32 through which he will move head E to contact ball K. Due to such alignment of face 30 with path 32, the user G will have increased success in propelling the ball K along the path 32'.

Figure 6:
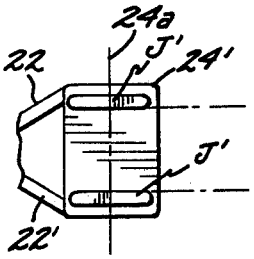
FIG. 6 is a top plan view of a second form of the sighting device.

A second form A' of the sighting device is shown in FIG. 6 in which the body 24' is of greater width than the body 24, and the first and second insignia J' are two elongate, visibly distinct colored areas that are substantially different in appearance from the surface of body 24' on which they are defined. Insignias J' are normally disposed relative to the axis 24a that extends therethrough.

Figure 7:
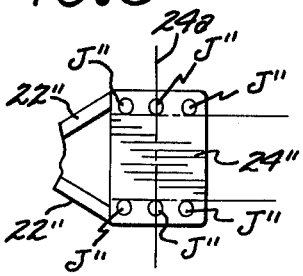
FIG. 7 is a top plan view of a third form of the device.

A third form A'' of the sighting device is illustrated in FIG. 7 wherein the body 24'' is wider than the body 24, and the first and second insignia J'' are a sequence of visibly distinct colored areas that are disposed in pairs on axis, parallel to the axis 24*a*.

The second The second and third forms of the sighting device A' and A'' are used in the same manner and produce the same results as the first form A.

The use and operation of the invention has been explained previously in detail and need not be repeated.

I claim:

1. In combination with a golf putter having a shaft that supports a flat golf club striking surface, a sighting device that may be removably and adjustably mounted on said shaft to permit a golfer to concurrently see first and second laterally spaced areas of equal size when in his particular putting stance only when said device has been so adjusted on said shaft that said striking surface is normal to the arcuate path through which said head moves prior to said striking surface contacting the golf ball to be putted, said sighting device including:

a. a single clamp removably and adjustably supported on said shaft above said head; and b. a body that extends outwardly from said clamp, said body having first and second end portions that define said first and second areas of equal size, said first and second areas being laterally spaced from one another a distance as least as great as the diameter of the section of said shaft from which said clamp is supported, said body being partially concealed by said shaft by being disposed thereunder when said user is in said particular putting stance, and said first and second areas being concurrently visible to said user when in said particular stance only when said shaft and head are so oriented that said striking surface is normal to said arcuate path through which said head will move in the putting of a golf ball.

2. A sighting device as defined in claim 1 in which said first and second areas are vivid in color and are defined on said first and second end portions.

3. A sighting device as defined in claim 2 in which said first and second end portions are in the form of balls.

* * * * *